United States Patent [19]

Fujikawa et al.

[11] 4,257,367

[45] Mar. 24, 1981

[54] ENGINE STARTING DEVICE

[75] Inventors: Tetsuzo Fujikawa, Kobe; Tomoya Kimura, Kakogawa, both of Japan

[73] Assignee: Kawasaki Jukogyo Kabushiki Kaisha, Kobe, Japan

[21] Appl. No.: 39,418

[22] Filed: May 15, 1979

Related U.S. Application Data

[63] Continuation of Ser. No. 853,071, Nov. 21, 1977, abandoned.

[30] Foreign Application Priority Data

| | | | |
|---|---|---|---|
| Nov. 22, 1976 | [JP] | Japan | 51-140345 |
| Nov. 22, 1976 | [JP] | Japan | 51-156649 |
| Nov. 22, 1976 | [JP] | Japan | 51-156650 |
| Nov. 22, 1976 | [JP] | Japan | 51-156651 |
| Nov. 22, 1976 | [JP] | Japan | 51-156652 |

[51] Int. Cl.[3] ..... F02N 3/02; F01L 13/08

[52] U.S. Cl. ..... 123/185 BB; 74/6; 74/140; 123/179 SE; 123/182; 123/187.5 R

[58] Field of Search ..... 123/179 SE, 182, 185 BB, 123/187.5 R; 74/6, 140

[56] References Cited

U.S. PATENT DOCUMENTS

| | | | |
|---|---|---|---|
| 3,018,768 | 1/1962 | Thompson | 123/185 BB |
| 3,361,124 | 1/1968 | Fend | 123/182 X |
| 3,626,937 | 12/1971 | Gjovik | 123/185 BB X |

*Primary Examiner*—Allan D. Herrmann

*Attorney, Agent, or Firm*—Jordan and Hamburg

[57] ABSTRACT

A rope for actuating a recoil starter is trained about a movable pulley outside a main body of the recoil starter, and the movable pulley is rotatably supported by a swing arm or a handle. By moving the swing arm in swinging movement or pulling the handle, the movable pulley can be moved to thereby pull the rope out of the main body of the recoil starter to start the engine. By virtue of the action of the movable pulley, the distance covered by the movement of the swing arm or the handle is smaller than the length of the portion of the rope paid out of the main body of the recoil starter to actuate the recoil starter. At least one further pulley may be provided for guiding the rope in its movement, and a manually operated handle may be additionally attached to the rope. Pulling of the rope automatically makes it possible to actuate an auxiliary engine starting means.

1 Claim, 16 Drawing Figures

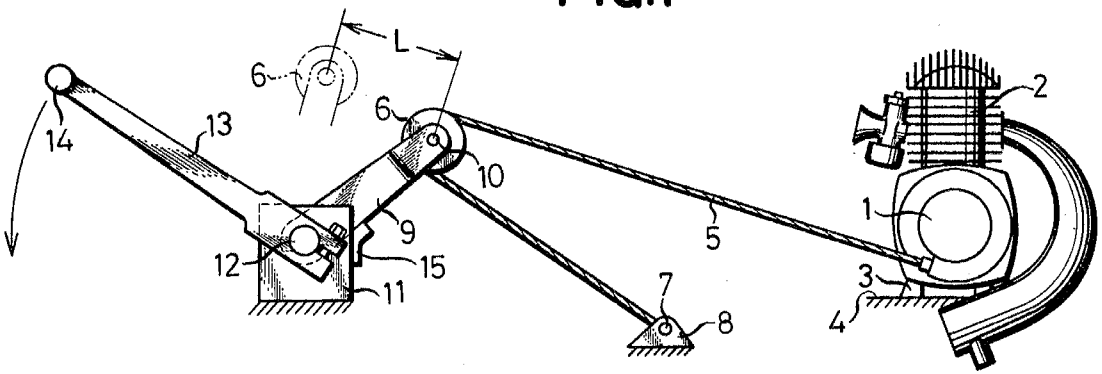
FIG. I
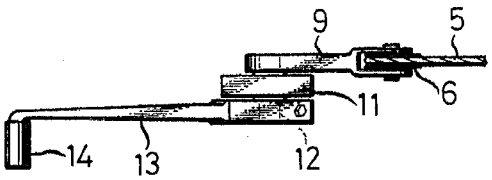
FIG. Ia

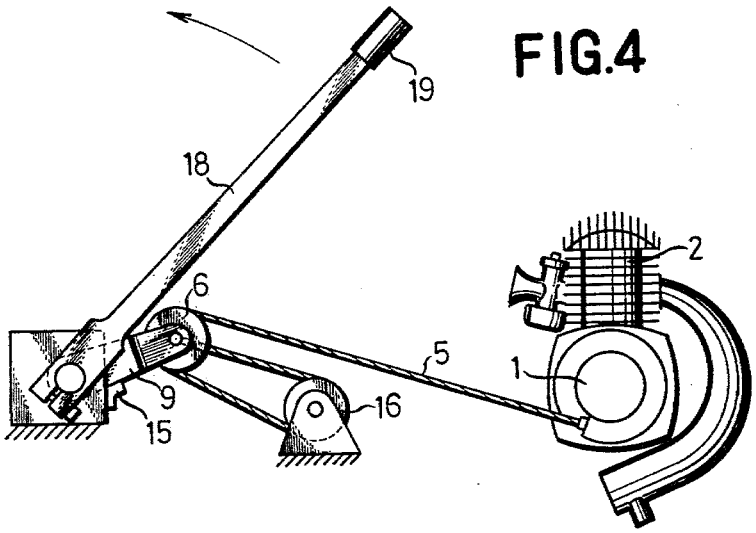
FIG.4
FIG.5
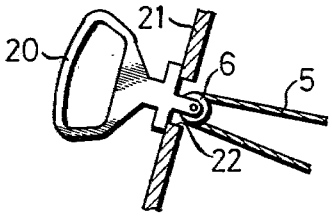

ENGINE STARTING DEVICE

This is a division, of application Ser. No. 853,071 filed Nov. 21, 1977, now abandoned.

BACKGROUND OF THE INVENTION

This invention relates to starting devices for engines, and more particularly to an engine starting device which has a recoil starter.

In engine starting devices of the recoil starter type (manually rope pulling type) of the prior art, it has been necessary to provide a pulling stroke which is equal to the length of the rope pulled out of the recoil starter. When one of such engines is mounted on a snow mobile, for example, a difficulty has hitherto been encountered in starting the engine with the driver of the snow mobile being seated in the driver's seat. More specifically, if the driver remains seated in the driver's seat, it is difficult to pull the rope with vigor to draw out of the recoil starter a sufficiently large length of rope to start the engine. Thus, it has hitherto been required for the driver or other rider to get off the snow mobile to pull the rope in starting the engine.

In engine starting devices of the pedal kick type, it has hitherto been necessary to use a plurality of gears in combination for rotating the engine shaft at a predetermined number of revolutions by kicking the pedal and moving the same through a predetermined stroke. This has required more space than is absolutely necessary for mounting the engine starting device and consequently increased production cost.

SUMMARY OF THE INVENTION

Accordingly, an object of the present invention is to provide a starting device for an engine provided with a recoil starter wherein the elongated flexible element for actuating the recoil starter can be pulled out of the recoil starter in a length necessary for starting the engine by moving the actuating means for the recoil starter a distance which is much smaller than the length of the portion of the elongated flexible element pulled out of the recoil starter.

Another object is to provide an engine starting device which is simpler in construction and lower in cost than engine starting devices of the prior art which utilize gears.

In accordance with the present invention, a movable wheel means, such as a pully or sprocket wheel, is supported by an actuating means, such as a swing arm or handle, and an elongated flexible element, such as a rope, wire, chain, for actuating the recoil starter is trained over the movable wheel means, so that the principle of operation of the movable wheel can be utilized to lessen the distance covered by the movement of the actuating means to thereby rotate the engine shaft even if the distance covered by the movement of a kicked arm or a manually operated handle lever is small. If the present invention is applied to an engine starting device of the type in which a handle is pulled by hand linearly when the engine is to be started, it is possible to pull out of a recoil starter main body the elongated flexible element in a length sufficiently large to start the engine by pulling the handle only a small distance. Since the device according to the invention does not need a gearing, the device is compact in size, simple in construction and low in cost. If a fixed wheel means is used additionally in combination with the movable wheel means and the elongated flexible element is moved in three runs disposed in superposed relation, the distance covered by the movement of the actuating means can be reduced substantially to $\frac{1}{3}$ the distance covered by the movement of the manually operated handle of the prior art. Moreover, if a plurality of movable wheel means are supported by the actuating means and a plurality of fixed wheel means are provided for rotation so as to cause the elongated flexible element to move in four runs disposed in superposed relation, it is possible to reduce the distance covered by the movement of the actuating means to substantially less than $\frac{1}{4}$ the distance covered by the movement of the manually operated handle of the prior art. Thus it is possible to obtain a still more compact size in an engine starting device of the recoil starter type.

Additional and other objects, features and advantages of the invention will become apparent from the description set forth hereinafter when considered in conjunction with the accompanying drawings.

BRIEF DESCRIPTION OF THE DRAWINGS

FIG. 1 is a side view of a first embodiment of the engine starting device in conformity with the invention wherein the elongated flexible element for actuating the recoil starter is turned back once to move in two runs disposed in superposed relation and the actuating means comprises a swing arm;

FIG. 1*a* is a fragmentary plan view of the embodiment shown in FIG. 1;

FIG. 4 is a side view of a fourth embodiment wherein the actuating means comprises a hand lever;

FIG. 5 is a fragmentary side view, with certain parts being shown in section, of a fifth embodiment wherein the actuating means comprises a grip handle;

DETAILED DESCRIPTION OF THE PREFERRED EMBODIMENTS

Figure 2:
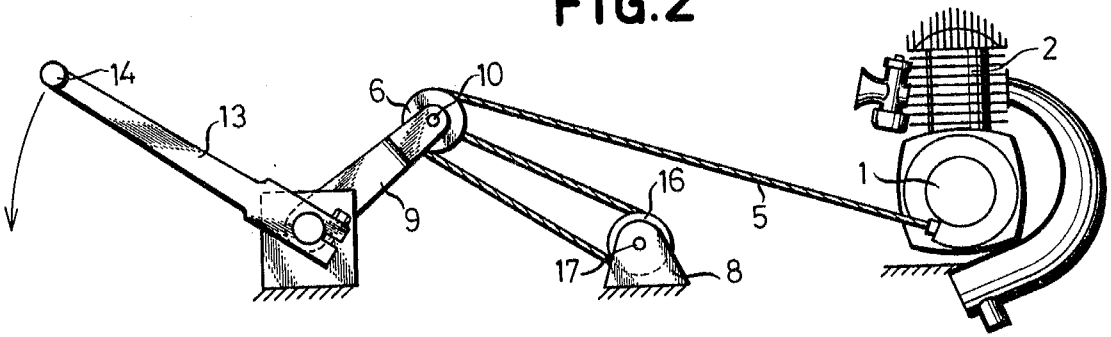
FIG. 2 is a side view of a second embodiment wherein the elongated flexible element is turned back twice to move it three runs disposed in superposed relation.

The present invention will now be described with reference to various preferred embodiments thereof shown in the accompanying drawings. In FIG. 1, a main body of a recoil starter 1 is attached to an engine 2 which is supported on a forward end portion 4 of a body of a snow mobile, for example, as by vibration absorbing rubber members 3. A rope 5 for actuating the recoil starter which extends rearwardly (leftwardly in FIG. 1) of the recoil starter main body 1 is trained over a pulley 6 movable in position (hereinafter referred to as a movable pulley) and turned back toward the recoil starter main body 1 to have its forward end secured to a rope fastening pin 7, so that the rope 5 moves in two runs disposed in superposed relation with the movable pulley 6 serving as a turning point. The rope fastening pin 7 is attached to a bracket 8 supported by the body of the vehicle. The movable pulley 6 is rotatable supported by a support shaft 10 fixedly secured to the upper end of a swing arm 9 which acts as an actuating means, the swing arm 9 being secured at its lower end to one end of a support shaft 12 rotatably supported through a bearing by a support member or a bracket 11 secured to the vehicle body (see FIG. 1*a*). The swing arm 9 has operatively connected thereto a kicked arm 13 which is secured at its lower end to the other end of the support shaft 12. The kicked arm 13 has a pedal 14 attached to its upper end. A stopper 15 for restricting the return movement of the swing arm 9 is secured to the bracket 11.

FIG. 1 shows the pedal 14 of the kicked arm 13 in an inoperative position, and the rope 5 is pulled toward the recoil starter main body 1 because a take-up reel (not shown) within the recoil starter main body 1 is under the influence of a return spring (not shown) which causes the rope 5 to be wound on the take-up reel by its biasing force. The tensile force acting on the rope 5 causes the swing arm 9 to press against the stopper 15, so that the pedal 14 is maintained in a position shown in FIG. 1. If the pedal 14 in this position is pressed, then the movable pulley 6 moves in the direction of the upper run of the rope 5 along an arc centered at the support shaft 12 to a dash-and-dot position which is spaced from the original position a distance L while rotating. Since the rope 5 moves in two runs one superposed above the other with the movable pulley 6 serving as a turning point, the rope 5 of a length which is substantially twice the distance L covered by the movement of the movable pulley 6 is paid out of the take-up reel within the recoil starter main body 1. Generally, when the rope is pulled out by hand without using a movable pulley 6, it is necessary to pull out about 700 to 800 mm of the rope. Thus, when the device shown in FIG. 1 is used, the distance L will be one half the length of the rope 5 pulled out by hand or 350 to 400 mm, so that it will be possible to cause a sufficiently large length of rope 5 to be paid out by pressing the pedal 14 a small distance. Upon the engine being started after pressing the pedal 14, the driver has only to release the pedal 14. The rope 5 will then be automatically pulled back into the recoil starter main body 1 by the biasing force of the return spring mounted within the recoil starter main body 1 as aforesaid, thereby returning the swing arm 9 to the inoperative position shown in FIG. 1 in which the swing arm 9 is pressed against the stopper 15.

If the rope 5 is trained over the movable pulley 6 and turned back toward the recoil starter main body 1 and the forward end of the rope 5 is fixed in position, the rope 5 moves in two runs one superposed above the other with the movable pulley 6 serving as a turning point. By this arrangement, the distance covered by the movement of the movable pulley 6 or the distance covered by the movement of the pressed pedal 14 for pulling out a predetermined length of rope 5 can be reduced to substantially one half the length of the rope which would have to be pulled out if the rope were pulled directly by hand. If the starting device shown in FIG. 1 is mounted on a snow mobile, the engine can be started while the driver is being seated on his seat. Since the device is simple in construction, it is low in cost.

Figure 2A:
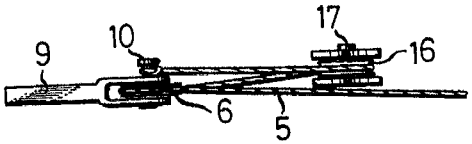
FIG. 2*a* is a fragmentary plan view of the embodiment shown in FIG. 2.

As shown in FIG. 2, in order to reduce the stroke of the pedal 14, the rope 5 may be trained about the movable pulley 6 and turned back toward the recoil starter main body 1, and then trained about another pulley 16, which is fixed in position, and turned back toward the movable pulley 6 to be fastened at its forward end to an end of the support shaft 10 (See FIG. 2*a*), so that the rope 5 will move in three runs disposed in superposed relation with the movable pulley 6 and the fixed pulley 16 serving as turning points. 17 designates a support shaft of the fixed pulley 16. By this arrangement, the rope 5 of a length which is substantially three times the distance covered by the movement of the movable pulley 6 can be paid out of the take-up reel within the recoil starter main body 1. This reduces the distance covered by the pressed pedal 14 for pulling out a predetermined length of rope 5 to about one third the length of the rope which would have to be directly pulled out by hand. Structurally speaking, the length of the rope 5 is only slightly increased and only one fixed pulley 16 is additionally used, so that an increase in cost is negligible.

Figure 3:
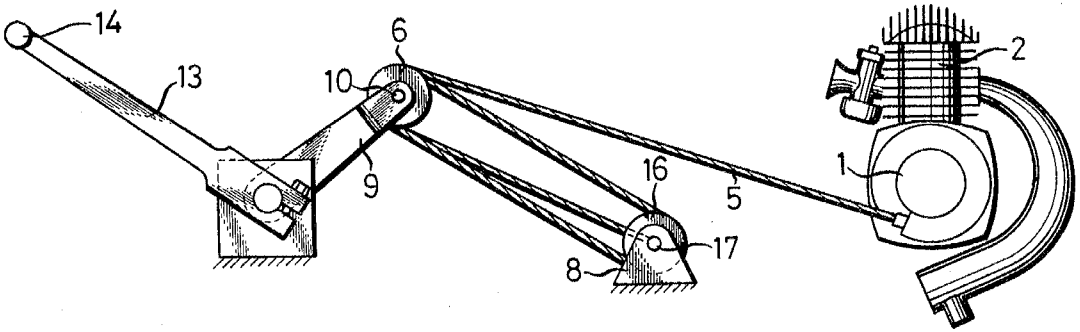
FIG. 3 is a side view of a third embodiment wherein the elongated flexible element is turned back three times to move in four runs disposed in superposed relation.
Figure 3A:
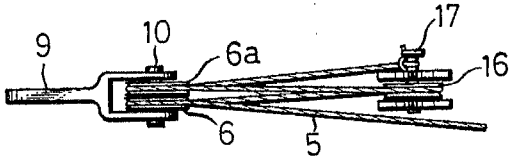
FIG. 3*a* is a fragmentary plan view of the embodiment shown in FIG. 3.

FIG. 3 shows an embodiment in which the rope 5 is moved in four runs disposed in superposed relation. The support shaft 10 supports two independent movable pulleys 6 and 6*a* for rotation (See FIG. 3*a*). The rope 5 turned back at the movable pulley 6 and the fixed pulley 16 is trained over the movable pulley 6*a* and turned back toward the recoil starter main body 1 to have its forward end fixed to an end of the support shaft 17. By this arrangement, the distance covered by the movement of the movable pulley 6 for pulling out a predetermined length of the rope 5 is reduced to substantially one fourth the length of the rope which would have to be pulled out if hand were directly used. The distance covered by the movement of the pressed pedal 14 is correspondingly reduced.

Over three movable pulleys may be rotatably mounted on the support shaft 10 and over two fixed pulleys may be rotatably mounted on the support shaft 17, and the rope 5 is turned back from the movable pulley 6 and trained over the fixed pulley 16 from which it is trained over another movable pulley so that the rope 5 may be trained over a plurality of pulleys. The rope 5 may be fixed at its forward end to a fixed part, such as the support shaft or bracket 8, or the actuating means such as the support shaft 10 or the swing arm 9. By this arrangement, it is possible to cause the rope 5 to move in over five runs disposed in superposed relation by using the movable pulley means and the fixed pulley means as turning points.

FIGS. 4 and 5 illustrate embodiments of the engine starting device which can be operated manually. In FIG. 4, the numerals 18 and 19 designate a handle lever and a handle grip respectively which serve as an actuating means. In FIG. 5, the numeral 20 designates a handle grip which serves as an actuating means, and the numeral 21 designates a handle support bracket formed therein with an opening 22 permitting the movable pulley 6 and the rope 5 to move therethrough. In the embodiments shown in FIGS. 4 and 5, the arrangement of the rope and the pulley or pulleys may be similar to the arrangement thereof shown in one of the embodiments shown in FIGS. 1 to 3.

From the foregoing description, it will be appreciated that the present invention offers an advantage in that by using a device of simple construction, it is possible to reduce the stroke of the actuating means and yet to cause the rope 5 of a sufficient length to start the engine to be paied out of the take-up reel within the recoil starter.

If the engine starting device according to the invention is mounted on a snow mobile as aforesaid and the recoil starter of the engine mounted in the forward end portion of the body of the vehicle is connected through a rope to the actuating means of the device which is in the form of a swing arm coupled to a kicked arm and located near the driver's seat, the driver can start the engine by pressing the kicked arm by foot while accelerating the engine by the right hand without removing himself from the driver's seat. Thus starting of the engine can be facilitated. However, in the embodiments shown and described hereinabove, particularly in the embodiments wherein the actuating means is in the form of a swing arm, the direction in which the rope extends at the outlet of the rope in the recoil starter main body will undergo a change each time the swing arm is moved in swinging motion. The rope pulled out of the recoil starter main body will rub against the inner surface of the rope outlet and a frictional loss will be produced. This not only makes it necessary to increase the force with which the kicked arm is pressed because the kicked arm offers increased resistance but also causes the rope to be broken prematurely.

Figure 6:
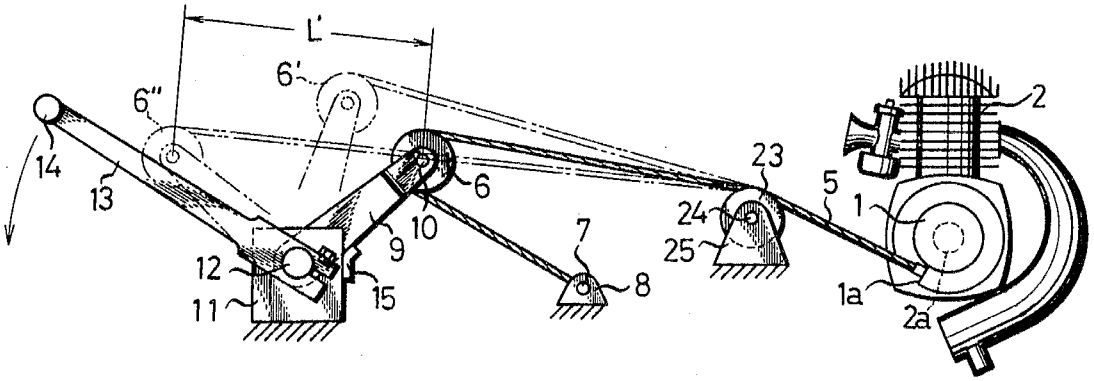
FIG. 6 is a side view of a sixth embodiment wherein the elongated flexible element for actuating the recoil starter is guided by guide means in its movement.
Figure 7:
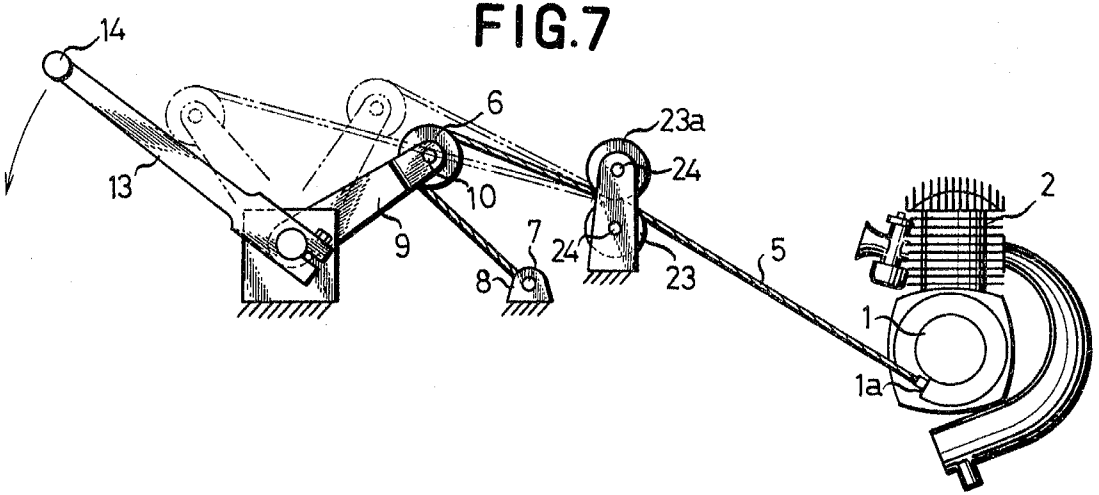
FIG. 7 is a side view of a modification of the sixth embodiment shown in FIG. 6.

In an embodiment shown in FIG. 6 and a modification thereof shown in FIG. 7, a rope guide means is provided between the swing arm and the recoil starter main body in an effort to solve the aforesaid problem by keeping the rope oriented in an optimum direction near the rope outlet of the recoil starter.

FIG. 6 illustrates an embodiment wherein a rope guide means is provided in an engine starting device of the same construction as shown in FIG. 1. Therefore, parts shown in FIG. 6 which are similar to those shown in FIG. 1 are designated by like reference characters and the detailed description thereof is omitted. In FIG. 6, the engine 2 having a recoil starter as shown in FIGS. 1 to 5 is mounted in an engine room disposed at the forward end portion of a snow mobile, for example, in such a manner that a crankshaft 2*a* is disposed across the width (perpendicular to the plane of the figure) of the snow mobile which mounts the engine 2. The recoil starter main body 1 mounts therein a take-up reel (not shown) for winding the rope 5 thereon and a return spring (not shown) for urging the take-up reel by its biasing force to rotate in a direction in which the rope 5 is wound thereon. The rope 5 extending through the outlet 1*a* is directed tangentially (leftwardly in the figure) of the take-up reel, and the support shaft 12 extending across the width of the vehicle body is rotatably supported through a bearing by the bracket 11 secured to the floor of the vehicle body in a position near to the right foot of the driver, as in the embodiment shown in FIG. 1. The tensile force acting on the rope 5 causes the swing arm 9 to press against the stopper 15, so that the pedal 14 is maintained in a position in which it can readily be pressed by a foot of the driver.

In the embodiment shown in FIG. 6, the rope guide means comprising a fixed pulley 23, which is fixed in position, is located between the recoil starter main body 1 and the movable pulley 6 for guiding the rope 5 to move in an optimum direction. The pulley 23 is rotatably supported by a support shaft 24 which in turn is supported by a bracket 25 secured to the vehicle body.

When the pedal 14 at the forward end of the kicked arm 13 is pressed in the direction of an arrow as is the case with the embodiments shown in FIGS. 1 to 3, the movable pulley 6 moves to a dash-and-dot line position 6″ by passing a dash-and-dot line position 6′ (distance L′). If the force exerted on the pedal 14 is removed, the rope will be wound on the take-up reel by the biasing force of the return spring within the recoil starter main body 1, so that the movable pulley 6 will return to its original position from the dash-and-dot line position 6″ through the dash-and-dot line position 6′, so that the starting device is rendered inoperative as shown in FIG. 6. In case the engine is not started by pressing the pedal 14 once, one has only to repeatedly kick the pedal as in the embodments shown in FIGS. 1 to 3.

In the embodiment shown in FIG. 6, the position of the fixed pulley 23 is selected such that the direction in which the rope is oriented during its movement out of and into the rope outlet l*a* is kept in an optimum direction (for example, in a tangential direction of the recoil starter main body 1 so that the rope will not rub against the edge of the rope outlet 1*a*). Owing to this arrangement, a portion of the rope 5 that has passed the fixed pulley 23 turns downwardly and extends toward the movable pulley 6. Thus although the position of the movable pulley 6 moves vertically while the pedal 14 is kicked by the driver, at least a portion of the rope 5 disposed between the rope outlet 1*a* and the fixed pulley 23 is kept in a predetermined direction. This eliminates a frictional loss which would be caused by the rubbing action of the rope 5 against the edge of the rope outlet 1*a* and the wear on the rope 5 which would otherwise be caused. If the guide means comprises one fixed pulley 23 as shown in FIG. 6, there is no significant increase in cost because of simple construction. Since the pulley 23 is rotatably supported by the support shaft 24, a frictional loss in this part is very small and the kicked arm 13 can be moved with a low force.

The rope guide means shown in FIG. 7 comprises another fixed pulley 23*a*, which is fixed in position, for preventing the slip off of the rope in addition to the fixed pulley 23. This arrangement allows greater latitude in selecting the position in which the kicked arm 13 is mounted relative to the position of the engine 2. Particularly, the embodiment shown in FIG. 7 has utility in cases where the distance between the engine 2 and the kicked arm 13 is small and the kicked arm 13 is located at a relatively high level. The operation of the embodiments shown in FIGS. 6 and 7 is similar to the operation of other embodiments.

The rope guide means may comprise a nozzle means made of a material of low coefficient of friction in place of a pulley. Also, a fixed roller may be mounted on the pin 7 for rotation as in the embodiment shown in FIG. 2, and the rope 5 passing the fixed pulley 23 of the rope guide means and turned back by the movable pulley 6 may be trained over the fixed pulley supported by the pin 7 before it is fastened to one end of the support shaft 10, for example. This makes it possible to move the rope 5 in three runs between the movable pulley 6 and the recoil starter main body 1, with a result that the rope of a sufficient length to start the engine can be paid out of the take-up reel with a small stroke of the pedal 14 of the kicked arm 13. It is to be understood that the rope guide means shown in FIGS. 6 and 7 can be provided in the embodiments of the engine starting device shown in FIGS. 3 to 5.

In the embodiments shown and described hereinabove, the actuating means for actuating the recoil starter may be operatively connected through the movable pulley to a portion of rope extended from a portion of rope wound on the take-up reel within the recoil starter main body 1, and the portion of the rope on a actuating means side may be continuous with the portion of rope within the recoil starter main body so as to pull out the latter from the recoil starter by pressing the pedal of the kicked arm of the actuating means. This enables the actuating means to be mounted in any position convenient for operation. Particularly in a snow mobile wherein the engine is located at some distance from the driver's seat, an engine starting device which can be operated with ease can be provided. However, if the portion of the rope in the recoil starter main body and the portion of the rope connected to the actuating means are merely interconnected, it will be impossible to start the engine when the actuating means is damaged and becomes unusable. Also, if the portion of the rope connected to the actuating means is broken and the portion thereof in the recoil starter main body is withdrawn into the recoil starter main body, it will become impossible to start the engine.

Figure 8:
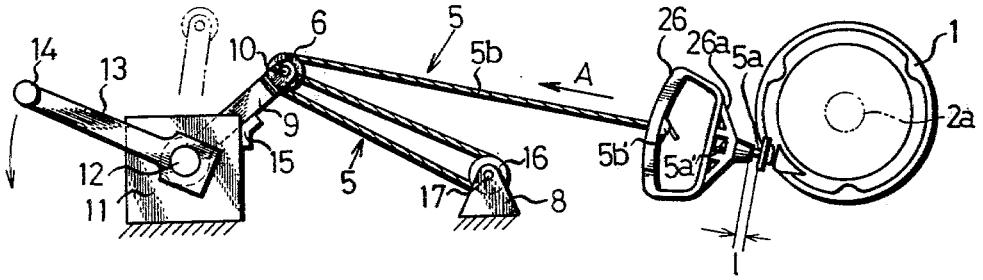
FIG. 8 is a side view of an eighth embodiment wherein a manually operated handle is mounted midway in the elongated flexible element for actuating the recoil starter.

FIG. 8 shows an embodiment wherein the aforementioned problem can be solved by means of a manually operated handle for connecting a length of rope, which is wound on the take-up reel within the recoil starter main body when the recoil starter is inoperative, with a length of rope connected to the actuating means. In FIG. 8, parts similar to those shown in FIGS. 1 to 7 are designated by like reference characters and the detailed description thereof is omitted.

In the embodiment shown in FIG. 8, a length of rope is wound on a take-up reel (not shown) within the recoil starter main body 1. By causing the length of rope within the recoil starter main body to be paid out of the take-up reel in the direction of an arrow A, it is possible to start an engine (not shown) with which the recoil starter is associated, as in the embodiment shown in FIG. 2. When the engine of the type described is mounted on a snow mobile, the crankshaft 2*a* is arranged across the width of the vehicle (perpendicular to the plane of the figure) and the recoil starter is arranged in such a manner that the rope 5 within the recoil starter main body 1 can be pulled out toward the driver's seat (leftwardly in the figure), as in other embodiments. The actuating means includes the swing arm 9 and the kicked arm 13. The movable and fixed pulleys 6 and 16 are arranged in the same manner as in the embodiment shown in FIG. 2. The shaft 12 extends across the width of the vehicle and pivotally supports at both ends thereof, through a fixing means (not shown), the lower ends of the swing arm 9 and the kicked arm 13 having at its upper end the pedal 14 to be pressed by foot. The pedal 14 shown in FIG. 8 is in an inoperative position and ready to be pressed for starting the engine.

The embodiment shown in FIG. 8 differs from the embodiment shown in FIG. 2 in that the rope 5 is divided into a rope portion 5*a* wound on the take-up reel within the recoil starter main body 1 and a rope portion 5*b* on a actuating means side, and a manually operated starter handle 26 is interposed between the two portions of the rope 5*a* and 5*b*. One end of the rope portion 5*b* is connected to a grip of the starter handle 26, while one end of the rope portion 5*a* is connected to a boss 26*a* of the handle 26. 5*a*′ and 5*b*′ designate the knots of the rope portions 5*a* and 5*b* respectively. Since the rope is pulled in a direction opposite to the direction of the arrow A by the biasing force of the return spring within the recoil starter main body 1, the swing arm 9 is maintained in pressing engagement with the stopper 15 and the pedal 14 at the upper end of the kicked arm 13 is maintained in a position suitable for the next following kicking operation, as in the embodiments described previously. In this case, since the position of the handle 26 is determined such that a length l of the rope portion 5*a* is exposed between the handle 26 and the recoil starter main body 1 when the recoil starter is inoperative as shown, the rope portion 5*b* operatively connected, through the movable pulley 6, to the actuating means is under the influence of the return spring within the recoil starter main body 1, thereby enabling the kicked arm 13 to be maintained in a standby position in a stable manner.

The manner in which the embodiment of engine starting device shown in FIG. 8 is normally used and operates is similar to that of the embodiment shown in FIG. 2. However, in the embodiment shown in FIG. 8, the manually operated starter handle 26 is interposed between the rope portion 5*a* in the recoil starter main body 1 and the rope portion 5*b* on the actuating means side, so that even if the actuating means is put out of action due to damage done to some part thereof it is possible to start the engine by pulling the handle 26 by hand to pull out the rope portion 5*a*. Thus, the engine can be started both by pressing the pedal 14 of the kicked arm 13 and by pulling the handle 26 in the embodiment of FIG. 8. If the rope portion 5*b* connected to the actuating means were broken, the rest of the rope portion 5*b* and the rope portion 5*a* would be withdrawn into the recoil starter main body 1 unless the handle 26 is provided. The presence of the handle 26 is effective to prevent the ropes from being pulled entirely into the recoil starter main body 1. Since the actuating means is operatively connected to the recoil starter main body 1 by means of the rope 5*b*, it is possible to arrange the kicked arm 13 so that the pedal 14 will be located near the driver's seat even if the engine is located remote from the driver's seat as in the previously described embodiments.

It is to be understood that the handle 26 is not limited to the specific form shown in FIG. 8 and that any other form of handle may be used in place of the handle 26. Also, it is not essential to divide the rope into rope portions 5*a* and 5*b*, and the handle 26 may be connected to an intermediate portion of the single rope 5. The handle 26 may, of course, be used in the embodiments shown in FIG. 1 and FIGS. 3 to 7. More specifically, the rope can be turned back only once or more than twice by using the pulley or pulleys as the turning point or points as shown in FIGS. 1 and 3 (this arrangement enables the rope to be pulled out of the recoil starter main body 1 in a sufficiently large length to start the engine even if the pedal 14 is pressed in a very small stroke in the embodiment shown in FIG. 8 as in other embodiments, and the driver of a snow mobile, for example, can start the engine while sitting on the driver's seat or without getting off the vehicle), and the kicked arm 13 may be replaced by a handle lever (FIG. 4) or a handle grip (FIG. 5).

In starting an engine equipped with an auxiliary engine starting means, such as a decompression means and/or a fuel injection means, by means of a known recoil starter, it is common practice to pull out the rope with vigor in a relatively large length (for example 700 to 800 mm) while usually operating the auxiliary starting device by left hand. A difficulty is experienced in executing this operation, so that skills are required in performing this operation and a reduction in engine starting efficiency is inevitable where the operator has no such skills. A recoil starter of the prior art may be coupled to an auxiliary engine starting device. However, in the engine starting device of the prior art which has a manually operated handle secured to the forward end of the rope, a mechanism for actuating the auxiliary engine starting device after ascertaining that the rope has been pulled out is very complex in construction and unstable in operation.

Figure 9:
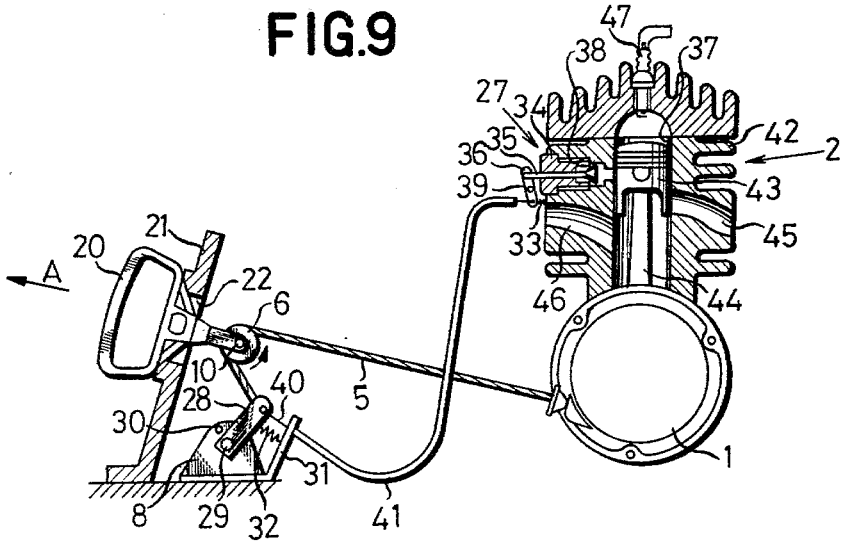
FIG. 9 is a side view, with certain parts being shown in section, of a ninth embodiment wherein the elongated flexible element for actuating the recoil starter can also actuate an auxiliary starting means.
Figure 10:
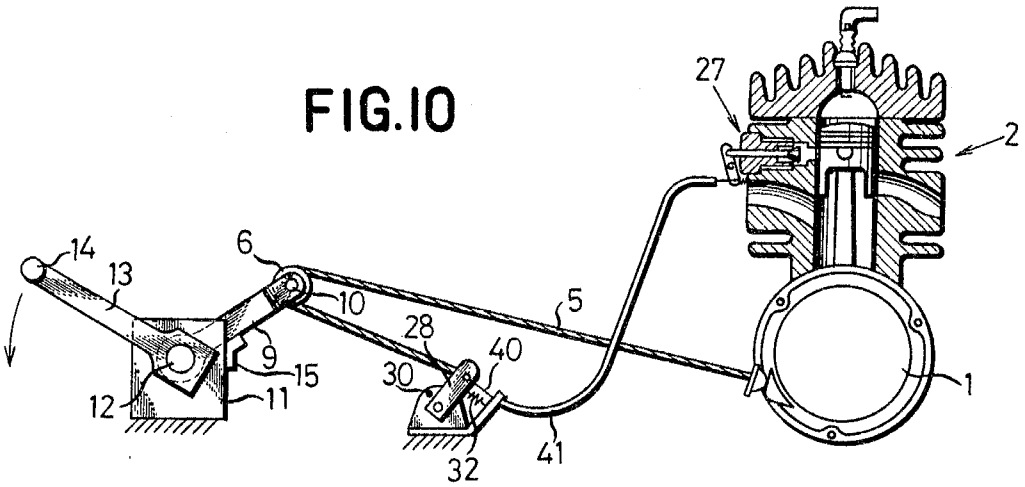
FIG. 10 is a side view, with certain parts being shown in section, of a modification of the embodiment shown in FIG. 9.

FIGS. 9 and 10 show an embodiment and its modification of engine starting device provided with an auxiliary engine starting device in which the auxiliary engine starting device is actuated in conjunction with the recoil starter when the latter is actuated in order to obviate the disadvantages of the prior art mentioned above. In the engine starting device shown in FIGS. 9 and 10, the principle of a movable pulley is utilized to rotate the crankshaft in a sufficiently large number of revolutions to start the engine by moving the pedal or handle in a small stroke, and at the same time the rope of the recoil starter is trained over a movable pulley and turned back toward the recoil starter so as to use the forward end portion of the rope as a means for actuating the auxiliary engine starting means.

The engine starting device coupled to an auxiliary engine starting means will now be described in detail by referring to FIGS. 9 and 10 wherein parts similar to those shown in FIGS. 1 to 8 are designated by like reference characters.

FIG. 9 is a side view, with certain parts being shown in vertical section, of the engine starting device having, in combination, the recoil starter main body 1 and a decompressing means 27. The engine 2 provided with the recoil starter main body 1 may, as in other embodiments described previously, be mounted in an engine room located in the forward portion of a snow mobile, for example, in such a manner that its crankshaft extends across the width of the vehicle (perpendicular to the plane of the figure). The rope 5 extending from the recoil starter main body 1 rearwardly thereof (leftwardly in the figure) and trained over the movable pulley 6 attached to the handle 20 serving as the actuating means is connected at its forward end to an upper end portion of a support arm 28 which is pivotally supported by a support shaft 29 mounted on the bracket 8 secured to the vehicle body and extending across the width thereof. 30 designates a support arm stopper. The handle support bracket 21 secured to the vehicle body is formed therein with the opening 22 for the movable pulley 6 and rope 5 to pass therethrough as in the embodiment shown in FIG. 5. The movable pulley 6 is pulled toward the recoil starter main body 1 through the rope 5 by the biasing force of the return spring mounted within the recoil starter main body 1 so that the handle 20 may be seated at the bracket 21. A spring 32 is mounted between the support arm 28 and a bracket 31, and the combined biasing force of the spring 32 and a tension spring 33 subsequently to be described is higher than the biasing force of the return spring mounted within the recoil starter main body 1 when the recoil starter is in an inoperative position as shown, so that the support arm 28 is released from engagement with the support arm stopper 30 and moves toward the bracket 31. At this time, the decompressing means 27 is closed.

The decompressing means 27 comprises a valve seat 34, a poppet type valve 35 and a lever 36 as shown. The valve seat 34 is threadably inserted into a threaded duct 38 opening in a cylinder surface 37 of the engine 2 and formed therein with a pressure releasing passage (not shown) which is adapted to be opened and closed by the valve 35. The pressure releasing passage may be formed, for example, by providing a longitudinally extending groove resembling a keyway at the inner surface of a bore in which the stem of the valve 35 is inserted. The lever 36, which is supported at its central portion by a bracket (not shown) on the engine through a support shaft 39, is connected to the valve 35 through a pin parallel to the support shaft 39. The lever 36 is connected at its lower end to one end of an inner wire 40 of a connecting wire means which is connected at the other end thereof to the upper end of the support arm 28 after extending through an opening formed in the bracket 31. The connecting wire means further includes an outer wire 41. The spring 33 is mounted between the lower end of the lever 36 and a cylinder 42 of the engine 2.

Of the two springs 32 and 33, at least the spring 33 has a biasing force which is higher than the biasing force of the return spring within the recoil starter main body 1 when the recoil starter is in an inoperative position. Thus the lever is urged by the biasing force of the spring 33 to move counterclockwise about the support shaft 39, with a result that the valve 35 is seated at the valve seat 34 as shown to thereby close the pressure releasing passage. In FIG. 9, 43 designates a piston; 44, a connecting rod; 45, an exhaust port; 46, a suction port; and 47, an ignition plug.

In starting the engine 2, the handle 20 is gripped by hand and pulled with vigor in the direction of the arrow A. This causes the movable pulley 6 to pull the rope out of the recoil starter main body 1 while rotating in the direction of an arrow, thereby rotating the crankshaft in a number of revolutions necessary for starting the engine, as in the embodiment shown in FIG. 5. At this time, the starting force exerted on the handle 20 is transmitted through the rope 5 to the support arm 28, and this force is higher than the combined biasing force of the springs 32 and 33, so that the support arm 28 moves in pivotal movement about the support shaft 29 until it abuts against the stopper 30. This pulls the inner wire 40 to move the lever 36 clockwise in pivotal movement about the support shaft 39. Thus while the handle 20 is being moved away from the bracket 21 in one stroke, the valve 35 is released from engagement with the valve seat 34 to thereby open the pressure releasing passage. Therefore, during the rotation of the crankshaft for starting the engine by a single operation of the handle 20, compressed gas is released through the pressure releasing passage until the piston 43 moves upwardly past the pressure releasing passage (threaded duct 38) of the decompressing means at each compression stroke. This facilitates the operation of the handle 20, thereby enabling the engine to be started readily.

If the force exerted on the handle 20 in the direction of the arrow A is removed, the valve 35 is closed by the combined biasing force of the springs 32 and 33. The engine continues in normal operation if it has been started by that time. In the event the engine is not started in a single operation of the handle 20, the handle pulling operation is repeated. When this is the case, the decompressing means 27 is automatically rendered operative while the handle 20 is being pulled in the direction of the arrow A to thereby release compressed gas from the engine.

In the embodiment shown in FIG. 9, the stroke of the handle 20 for pulling out the rope can be naturally reduced than the length of the rope 5 which has to be pulled out of the recoil starter main body in the prior art. Thus, if the embodiment shown in FIG. 9 is used in a snow mobile, the driver can readily start the engine by pulling the handle 20 in a short stroke with a light force while sitting on the driver's seat, because the decompressing means 27 is automatically actuated to thereby facilitate the pulling of the handle 20.

FIG. 10 shows a modification of the embodiment shown in FIG. 9 in which the engine starting device having the actuating means including the kicked arm 13 as shown in FIG. 1 is combined with the auxiliary starting means shown in FIG. 9 and comprising the decompressing means 27. Therefore, parts in FIG. 10 which are similar to the parts shown in FIG. 1 are designated by like reference characters and description thereof is omitted.

In the embodiments shown in FIGS. 9 and 10, the handle lever 18 shown in FIG. 4 may be used in place of the kicked arm 13 shown in FIG. 10. Also, as in the embodiment shown in FIG. 3, a pulley may be mounted at the upper end of the support arm 28 and the rope 5 may be trained over such pulley after being trained over the movable pulley 6 and turned back toward the recoil starter main body 1. The rope 5 may be secured at its forward end to the support shaft 10 of the movable pulley 6, or trained over another pulley supported by the support shaft 10 as shown in FIG. 3, with its forward end being connected to the support arm 28. By this arrangement, the operating stroke of the handle 20 or the kicked arm 13 can be further reduced. Additionally, the guide means shown in FIGS. 6 and 7 and/or the manually operated handle 26 shown in FIG. 8 can be used with the structures described by referring to FIGS. 9 and 10. A fuel injection means may be used in place of the decompressing means 27, or together with the decompressing means 27, as an auxiliary engine starting means. Like the decompressing means 27, the fuel injection means is operated by means of an inner wire 40.

From the foregoing description, it will be appreciated that by using the structures shown in FIGS. 9 and 10, it is possible to actuate the auxiliary starting means in conjunction with the recoil starter by a simple mechanism. These structures offer an advantage in that the operation of starting the engine can be performed positively by using an auxiliary starting means because the latter is actuated by a force transmitted by the forward end of the rope of the recoil starter (or the forward end of the rope turned back toward the recoil starter after being trained over the movable pulley 6). The use of the movable pulley enables the operating stroke of the handle or the kicked arm to be reduced, thereby improving the efficiency of operation and making it possible to obtain an overall compact size in an engine starting device.

In one type of snow mobile of the prior art, an engine provided with a recoil starter of the prior art is mounted in an engine room in the forward portion of the body of the vehicle, and the engine drives an endless track mechanism mounted on either side thereof for moving the snow mobile on the snow. In this type of snow mobile, a starting device generally used is of the type in which a handle attached to the forward end of a rope for actuating the recoil starter is directly gripped by hand and pulled toward the operator so as to pull the rope out of the recoil starter. If the engine starting device of the prior art is used, it may be impossible for the driver to operate the device while sitting in the driver's seat and the driver must get off the vehicle each time the engine is started, because the length of the rope that has to be pulled out of the recoil starter to start the engine is relatively large or in the range between 700 and 800 mm. Also, the driver must operate a throttle grip on the handle by left hand while pulling the handle by right hand. Thus skills are required for actuating the engine starting device of the prior art. If an engine starting device utilizing a gearing and a kicked arm as an actuating means is used, a difficulty will be encountered in designing a layout for the engine starting device in such a manner that no trouble is caused in actuating the engine starting device even if the device is mounted near the engine, because the engine is mounted in the engine room in the forward portion of the vehicle body. From the description set forth hereinabove, it will be apparent that by mounting the engine 2 provided with the starting device constructed as shown in FIGS. 1 to 10 on a snow mobile, it is possible to essentially eliminate the aforesaid disadvantages of the prior art. A snow mobile mounting thereon an engine provided with the engine starting device in accordance with the invention will be described by referring to FIGS. 11 and 13 which show in detail a particularly advantageous embodiment of the present invention as incorporated in a snow mobile.

It has been discovered that the side wall of a longitudinally extending tunnel-shaped cover for an endless track mechanism mounted on either side of a snow mobile is suitable for mounting a kick device for the starting device. In the embodiment of the invention incorporated in a snow mobile, the kick device is detachably mounted on the side wall of the tunnel-shaped cover, and the rope of the recoil starter extends rearwardly of the recoil starter along the side wall of the cover and connected to the kick device. The details of the concrete embodiment will now be described by referring to FIGS. 11 to 13 wherein parts similar to those shown in the previously described embodiments are designated by like reference characters.

The transversely located engine 2 provided with the recoil starter main body 1 is mounted in an engine room 50 in the forward portion of a snow mobile (right end portion in FIG. 11) and supported as by the vibration absorbing rubber members (See FIG. 1). A rope guide means comprising the fixed pulley 23 rotatably supported by a support shaft connected to the bracket 25 fixedly secured to the forward portion 4 of the vehicle body is provided as in the embodiment shown in FIG. 6. The rope 5 for actuating the recoil starter extends from the recoil starter main body 1 rearwardly thereof in an obliquely upward direction, passes the fixed pulley 23 at its upper portion into a kick means K is trained over the movable pulley 6 and turned back toward the recoil starter main body 1, is trained over the fixed pulley 16, and is connected at its forward end to the support shaft 10 for the movable pulley 6. This arrangement is similar to that of the embodiment shown in FIG. 2.

The kick device K comprises a kick case 51, the shaft 12 rotatably supported by a bush 51*a* (FIG. 12) secured to the kick case 51, the kicked arm 13 serving as the actuating means secured at its base to a portion of the shaft 12 extending outwardly of the kick case 51, the swing arm 9 serving as the actuating means and the fixed pulley 16. The swing arm 9 is fixed to the end of the kicked shaft 12 in the kick case 51. The kick case 51 is in the form of a box of a small thickness opening toward the central portion of the vehicle body and including a flange 51*b* at an edge thereof which is opposed to a vertical side wall 52*a* of a tunnel-shaped cover 52. The flange 51*b* is fastened to the side wall 52*a* by means of a plurality of bolts 53. An upper edge of the kick case 51 which is remote from the cover 52 is positioned against one side of a seat 54 so as to substantially seal the inner space of the kick case 51. 55 designates an aperture formed in the forward end of the case 51 for permitting the rope 5 to extend therethrough into the case 51. The fixed pulley 16 is rotatably supported by the support shaft 17 secured to the case 51 and extending across the width of the vehicle body. In this embodiment, the stopper 15 is mounted on an inner surface of the case 51. As in the embodiments described hereinabove, a rope take-up reel (not shown) in the recoil starter main body 1 is urged by the biasing force of a return spring (not shown) to rotate in a direction in which the rope 5 is wound on the take-up reel, a tensile force acts on the rope 5 which is in a standby position in FIG. 11 in which no pressure is applied to the kicked arm 13, so that the swing arm 9 is maintained in contact with the stopper 15 to keep the kicked arm 13 in the indicated position. 56 designates an endless track mechanism 57, a suspension wheel and 58 a throttle lever.

Pressing the kicked arm 13 in the direction of an arrow results in the swing arm 9 being released from engagement with the stopper 15 and moving in pivotal movement in the same direction as the kicked arm 13 about the shaft 12, as in the embodiments described hereinabove. At the same time, the movable pulley 6 pulls the rope 5 out of the recoil starter main body 1 while rotating counterclockwise about the support shaft 10, so as to rotate the crankshaft in a number of revolutions necessary for starting the engine. Removal of the pressure applied to the kicked arm 13 permits the rope 5 to be wound on the take-up roller within the recoil starter main body 1 by the biasing force of the return spring, with the kicked arm 13 returning to the position shown in FIG. 11 and the swing arm 9 returning to the position in which it abuts against the stopper 15. In the event the engine is not started in a single operation of the kicked arm 13, the same operation is repeated.

If the kick device K is detachably attached as by the bolts 53 to the vertical side wall 52*a* of the tunnel-shaped cover 52 for the endless track mechanism 56 and the kick device K is connected to the recoil starter main body 1 through the rope 5, it is possible to mount the kick device K in a position remote from the recoil starter main body 1 which is convenient for operating the kick device K. Thus there is offered the advantage of the driving being able to execute a starting operation while manipulating the throttle lever 58 by right hand. The vertical side wall 52*a* of the tunnel-shaped cover 52 provides an area which is suitable for supporting the kick device K, and the kick device K can be mounted in this area with ease. This offers an advantage in that the kick device K is mounted optionally on a snow mobile.

As in the embodiment shown in FIG. 2, the rope 5 can be trained over the movable pulley 6 supported at the forward end of the swing arm 9 through the support shaft 10 and the fixed arm 16 supported by the support shaft 17 connected to the kick case 51, so that the rope 5 can be moved in three runs arranged in superposed relation between the kick device K and the recoil starter main body 1. By this arrangement, it is possible to reduce the distance covered by the movement of the movable pulley 6 to substantially one third the length of the rope 5 which would have to be pulled out of the recoil starter main body 1 if the rope were directly pulled out by hand. This enables the stroke of the kicked arm 13 to be correspondingly reduced, so that it is possible to start the engine by kicking the kicked arm 13 and moving the same in a short stroke. Also, like the embodiment shown in FIG. 6, the rope guide means comprising the fixed pulley 23 supported by a shaft connected to the bracket 25 is provided so as to keep constant the position of the rope 5 between the recoil starter main body 1 and the fixed pulley 23, thereby minimizing the wear caused on the rope 5 at the rope outlet of the recoil starter main body 1. Mounting the kick device K on the outer surface of the vertical side wall 52*a* of the tunnel-shaped cover 52 as shown in FIG. 11 offers the advantage of being able to readily attach or detach the kick device K to a snow mobile.

Figure 11:
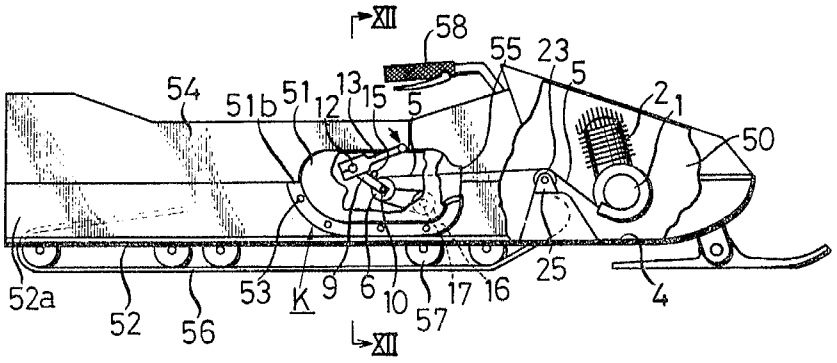
FIG. 11 is a side view of a snow mobile on which the engine starting device incorporating the present invention is mounted.
Figure 13:
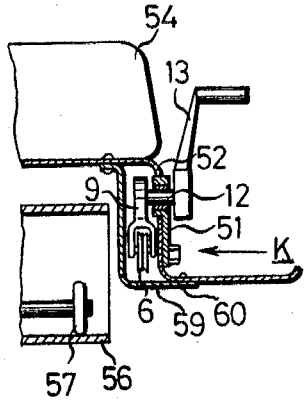
FIG. 13 is a partially sectional view similar to FIG. 12 but showing another example of snow mobile in which the present invention is applied.
Figure 12:
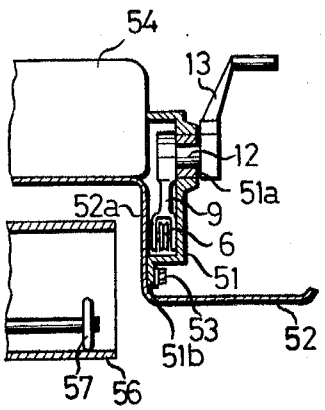
FIG. 12 is a partially sectional view taken along the line XII—XII in FIG. 11.

FIG. 13 shows a modification of the embodiment shown in FIGS. 11 and 12 in which the kick device K is mounted on the inner surface of the side wall of a tunnel-shaped cover 52. 59 designates a swing arm cover which is secured to the tunnel-shaped cover 52 by means of a plurality of bolts 60. The modified structure shown in FIG. 13 offers the advantage of the side wall of the tunnel-shaped cover 52 having an improved outer appearance.

In the embodiment shown in FIGS. 11 to 13, the kicked arm 13 can be folded toward the seat 54. Also, as shown in FIG. 1, the fixed pulley 16 may be eliminated and the forward end of the rope 5 can be tied to a fastening member located in the position of the support shaft 17 after being trained over the movable pulley 6, so that the rope 5 will move in two runs between the movable pulley 6 and the recoil starter main body 1. If it is necessary to reduce the stroke of the kicked arm 13, another movable pulley may be mounted in the support shaft 10 as shown in FIG. 3 and the rope 5 may be trained thereover, with the forward end of the rope being tied to the support shaft 17 or other suitable fixed part to move the rope 5 in four runs between the movable pulley 6 and the recoil starter main body 1. It is also possible to further increase the number of the movable pulleys and fixed pulleys to enable the rope 5 to move in over five runs.

It will also be understood that the handle lever shown in FIG. 4 or the grip handle shown in FIG. 5 may be used in place of the kicked arm 13 of the kick device K, that the guide means may be modified into the form of guide means shown in FIG. 7, that the manually operated handle shown in FIG. 9 may be connected to the rope, and that the auxiliary starting device shown in FIGS. 9 and 10 may be provided and actuated in conjunction with the actuation of the rope 5. It will be apparent that these features may be suitably used in combination to provide a modification of the structure shown in FIGS. 11 to 13.

The present invention has been shown and described hereinabove with reference to various preferred embodiments. It will be understood that the invention is not limited to the specific forms of the structure shown and described and that many changes and modifications can be made therein. It is also to be understood that the engine starting device according to the invention can be mounted not only on a snow mobile but also on various vehicles and machines which are equipped with engines. It will be apparent to one skilled in the art that various parts and features of the embodiments of the device shown in the drawings can be combined with one another to form an embodiment or embodiments even if such combinations are not described in this specification, such combinations being covered by the present invention. In the embodiments shown and described hereinabove, the recoil starter has been shown and described as being actuated by a rope, but it is to be understood that any elongated flexible element, such as a wire, cord, chain, etc. can be used in place of a rope. When a chain is used, the pulleys will naturally be replaced by sprockets.

What we claim is:

1. An engine starting device comprising: recoil starter means including a main body and an actuating elongated flexible element adapted to be pulled out of said main body to actuate an engine for starting the same; actuating means for pulling the elongated flexible member of said recoil starter means; a movable wheel means rotatably supported by said actuating means and having an intermediate portion of said elongated flexible element trained thereover; said movable wheel means being moved when said actuating means is operated whereby the elongated flexible element can be pulled out of said main body of the recoil starter means in a length which is greater than the distance covered by the movement of said movable wheel means; and auxiliary engine starting means connected to the forward end of said elongated flexible element after the latter is trained over said movable wheel means and turned back toward the main body of said recoil starter means with the movable wheel means serving as a turning point, whereby said auxiliary engine starting means can be actuated simultaneously as said recoil starter means is actuated.

* * * * *